US011183352B2

(12) United States Patent
Yang

(10) Patent No.: US 11,183,352 B2
(45) Date of Patent: Nov. 23, 2021

(54) AIR CIRCUIT BREAKER

(71) Applicant: LS ELECTRIC CO., LTD., Anyang-si (KR)

(72) Inventor: Seungpil Yang, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 0 days.

(21) Appl. No.: 16/857,793

(22) Filed: Apr. 24, 2020

(65) Prior Publication Data

US 2021/0142971 A1 May 13, 2021

(30) Foreign Application Priority Data

Nov. 8, 2019 (KR) ..... 10-2019-0142904

(51) Int. Cl.

| | |
|---|---|
| ***H01H 33/28*** | (2006.01) |
| ***H01H 71/04*** | (2006.01) |
| ***H01H 31/02*** | (2006.01) |
| ***H01H 71/12*** | (2006.01) |

(52) U.S. Cl.

CPC ..... *H01H 71/04* (2013.01); *H01H 31/02* (2013.01); *H01H 33/28* (2013.01); *H01H 71/123* (2013.01)

(58) Field of Classification Search

CPC .. H01H 71/0228; H01H 71/16; H01H 71/125; H01H 71/2418; H01H 71/025; H01H 71/04; H01H 71/0264; H01H 71/0235; H01H 71/0207; H01H 71/02; H01H 71/1072; H01H 71/123; H01H 71/46; H02H 1/06; H02H 1/2058

See application file for complete search history.

(56) References Cited

U.S. PATENT DOCUMENTS

2015/0130567 A1* 5/2015 Jang ..... H01H 71/74 335/21
2018/0114660 A1* 4/2018 Kupsch ..... H01H 71/123

FOREIGN PATENT DOCUMENTS

| | | | |
|---|---|---|---|
| JP | H1098277 | A | 4/1998 |
| JP | 2017120803 | A | 7/2017 |
| KR | 20040042626 | A | 11/2002 |
| KR | 20090006679 | A | 7/2007 |
| KR | 100876407 | B1 | 12/2008 |
| KR | 20150139344 | A | 6/2014 |
| KR | 200483252 | | 4/2017 |

OTHER PUBLICATIONS

Korean Office Action for related Korean Application No. 10-2019-0142904; action dated Dec. 21, 2020; (4 pages).
Japanese Office Action for related Japanese Application No. 2020-076007; action dated Jun. 15, 2021; (5 pages).

* cited by examiner

*Primary Examiner* — Bryan R Perez
(74) *Attorney, Agent, or Firm* — K&L Gates LLP

(57) ABSTRACT

Disclosed is an air circuit breaker including a safety cover. According to embodiments disclosed herein, a setting unit of an overcurrent trip relay exposed to the outside through an opening is covered by the safety cover, and thus manipulation of the setting unit is not allowed before opening the safety cover. Accordingly, an accident due to malfunction or manipulation of the overcurrent trip relay by an unauthorized person may be prevented.

12 Claims, 9 Drawing Sheets

AIR CIRCUIT BREAKER

CROSS-REFERENCE TO RELATED APPLICATION

Pursuant to 35 U.S.C. § 119(a), this application claims the benefit of an earlier filing date of and the right of priority to Korean Application No. 10-2019-0142904, filed on Nov. 8, 2019, the contents of which are incorporated by reference herein in its entirety.

FIELD OF THE INVENTION

The present disclosure relates to an air circuit breaker, and more particularly, an air circuit breaker capable of preventing a malfunction of a setting unit of an overcurrent trip relay.

BACKGROUND OF THE INVENTION

A circuit breaker is an electrical device designed to protect load-side power lines and devices (or equipment) connected to a rear end of the circuit breaker in a power system from damage by interrupting current flow when a fault current flowing through a circuit of the power system is detected. An air circuit breaker is widely used as a main circuit breaker in large power consumers such as factories, which is provided at a rear end of a transformer.

In the air circuit breaker, an overcurrent trip relay designed to provide information (power factor, phase current, phase-to-phase voltage, and electric power quality information) of electric power flowing through a power circuit is included for the purpose of detecting a fault current, such as an overload or short circuit on an electrical (or power) circuit and cutting off current flow after the fault current is detected.

FIG. 1 is a perspective view illustrating an outer appearance of a related art air circuit breaker.

In the related art air circuit breaker, an overcurrent trip relay 20 is installed at one side of a front plate (or main cover) 11 of a circuit breaker body 10, as illustrated in FIG. 1. An auxiliary cover 12 that covers a periphery of the overcurrent trip relay 20 to support the overcurrent trip relay 20 is fixedly installed on one side (left side in FIG. 1) of the front plate 11 of the circuit breaker body 10.

At a lower half of a front surface of the overcurrent trip relay 20, a manipulation unit (or setting unit) configured to manipulate the overcurrent trip relay 20 and/or an indicator unit 21 is exposed to the outside. In addition, adjustment knobs for setting a plurality of reference values or operation sensitivity needed for the operation of the overcurrent trip relay 20 installed below the manipulation unit and/or the indicator unit 21. The adjustment knobs are hidden by a window cover detachably coupled to the auxiliary cover 12.

However, as for the related air circuit breaker, the manipulation unit and the indicator unit of the overcurrent trip relay are exposed to the outside. This can be problematic in that the overcurrent trip relay may be operated by an unauthorized user, or a malfunction due to an unintended touch or operation may occur.

SUMMARY OF THE INVENTION

An aspect of the present disclosure is to provide an air circuit breaker capable of solving the above-mentioned problems and other drawbacks.

In detail, the aspect of the present disclosure is to provide an air circuit breaker that includes a main cover installed on one surface of a circuit breaker body and having an overcurrent trip relay accommodating groove provided on one side thereof, an overcurrent trip relay accommodated in the overcurrent trip relay accommodating groove and provided with a setting unit configured to set a set value for a circuit breaking operation, an auxiliary cover connected to the main cover so as to cover between the main cover and the overcurrent trip relay and provided with an opening through which the overcurrent trip relay is exposed to outside, and a safety cover connected to the auxiliary cover so as to cover the setting unit of the overcurrent trip relay exposed to the outside through the opening and designed to be rotatable with respect to the auxiliary cover.

Embodiments disclosed herein provide an air circuit breaker that may include a main cover installed on one surface of a circuit breaker body and having an overcurrent trip relay accommodating groove provided on one side thereof, an overcurrent trip relay accommodated in the overcurrent trip relay accommodating groove and provided with a setting unit configured to set a set value for a circuit breaking operation, an auxiliary cover connected to the main cover so as to cover between the main cover and the overcurrent trip relay and provided with an opening through which the overcurrent trip relay is exposed to outside, and a safety cover connected to the auxiliary cover so as to cover the setting unit of the overcurrent trip relay exposed to the outside through the opening and designed to be rotatable with respect to the auxiliary cover.

The auxiliary cover may further include a lever hook configured to reciprocate on the auxiliary cover in a specific direction, so that the safety cover is coupled to the auxiliary cover, or separated from the auxiliary cover.

The lever hook may include a first member disposed at a front surface of the auxiliary cover, a second member disposed in a position on a rear surface of the auxiliary cover that corresponds to the first member, and an elastic body interposed between the second member and the auxiliary cover. The first member and the second member may be coupled to each other with the auxiliary cover interposed therebetween and may be pressed in the specific direction by the elastic body.

In addition, the first member may include a coupling protrusion protruding from a rear surface thereof and penetrating through the auxiliary cover and the second member. The second member may be provided with a coupling hole through which the coupling protrusion passes.

The coupling protrusion may be welded after passing through the auxiliary cover and the second member, so that the coupling protrusion has a cross-section width greater than a width of the coupling hole of the second member.

The auxiliary cover may be provided with an insertion groove recessed in a thickness direction to allow at least a portion of the first member to be inserted in the thickness direction, so that a reciprocating region in the specific direction is limited.

The first member may be provided with a through hole penetrating from a front surface toward a side surface thereof in a thickness direction. The auxiliary cover may be provided with a communication hole communicating with the through hole at a position where the lever hook is disposed when being pressed by the elastic body in the specific direction.

The communication hole may be formed through a front surface and a side surface of the auxiliary cover.

The auxiliary cover may include a support protrusion that protrudes from a rear surface thereof and supports one end of the elastic body. The second member may include an insertion protrusion protruding therefrom so as to allow another end of the elastic body to be inserted. The elastic body supported by the support protrusion may press the second member such that the lever hook is maintained in a first state in which the safety cover is coupled to the auxiliary cover.

The second member further include an engaging protrusion protruding toward the opening of the auxiliary cover. The safety cover may include a fixing hook protruding from a rear surface of the safety cover. The fixing hook may be engaged with the engaging protrusion to be coupled to the auxiliary cover when the lever hook is in the first state, and may be separated from the engaging protrusion when the lever hook is moved from the first state to a second state in which the elastic body is pressed.

The safety cover may include a rotating part protruding from one side thereof and inserted into the auxiliary cover so as to allow the safety cover to rotate relative to the auxiliary cover. The rotating part may include a first surface formed as a continuously curved surface, a second surface extending from the first surface and formed as a flat surface, and a third surface extending at a predetermined angle with respect to the second surface and formed as a flat surface.

In addition, the safety cover, when rotating relative to the auxiliary cover, is rotatable to a first rotation state in which the second surface is brought into contact with the auxiliary cover or the main cover so that no further rotation is allowed in the first rotation state, and to a second rotation state in which the safety cover further rotates in an original rotation direction from the first rotation state by receiving a predetermined pressure so that the third surface is brought into contact with the auxiliary cover or the main cover in the second rotation state.

In addition, the setting unit of the overcurrent trip relay may include a restore button for restoring the overcurrent trip relay by checking a displayed signal when a predetermined event occurs. The safety cover may be provided with a button hole opened at a position corresponding to the restore button so as to allow the restore button to be pressed while the opening of the auxiliary cover is covered by the safety cover.

According to the embodiments disclosed herein, since a safety cover has a size capable of covering an opening of an auxiliary cover, the safety cover covers a setting unit of an overcurrent trip relay exposed to the outside through the opening. Accordingly, manipulation of the setting unit is not allowed before opening the safety cover. Thus, manipulation of the overcurrent trip relay by an unauthorized person, or an accident caused by malfunction can be prevented.

Also, as a button hole of the safety cover is provided in a position corresponding to a restore button of the overcurrent trip relay, a user can easily press the restore button through the button hole even when the safety cover is closed with respect to a front surface of the overcurrent trip relay as it is being coupled to the auxiliary cover.

In addition, a lever hook in a first state can be prevented from being moved by inserting a wire, or the like through a communication hole and a through hole to make it fixed and bonded. The safety cover is not opened until the wire is removed, thereby preventing the setting unit of the overcurrent trip relay from malfunctioning or being operated by an unauthorized user.

Further, a shape of a rotating part allows the user to manipulate the overcurrent trip relay without a concern of the safety cover being closed again after the safety cover is rotated to a second rotation state from a first rotation state. As the safety cover is not closed toward the auxiliary cover again, the user can conveniently manipulate the overcurrent trip relay.

DETAILED DESCRIPTION OF THE INVENTION

Description will now be given of an air circuit breaker according to embodiments disclosed herein, with reference to the accompanying drawings.

Figure 1:
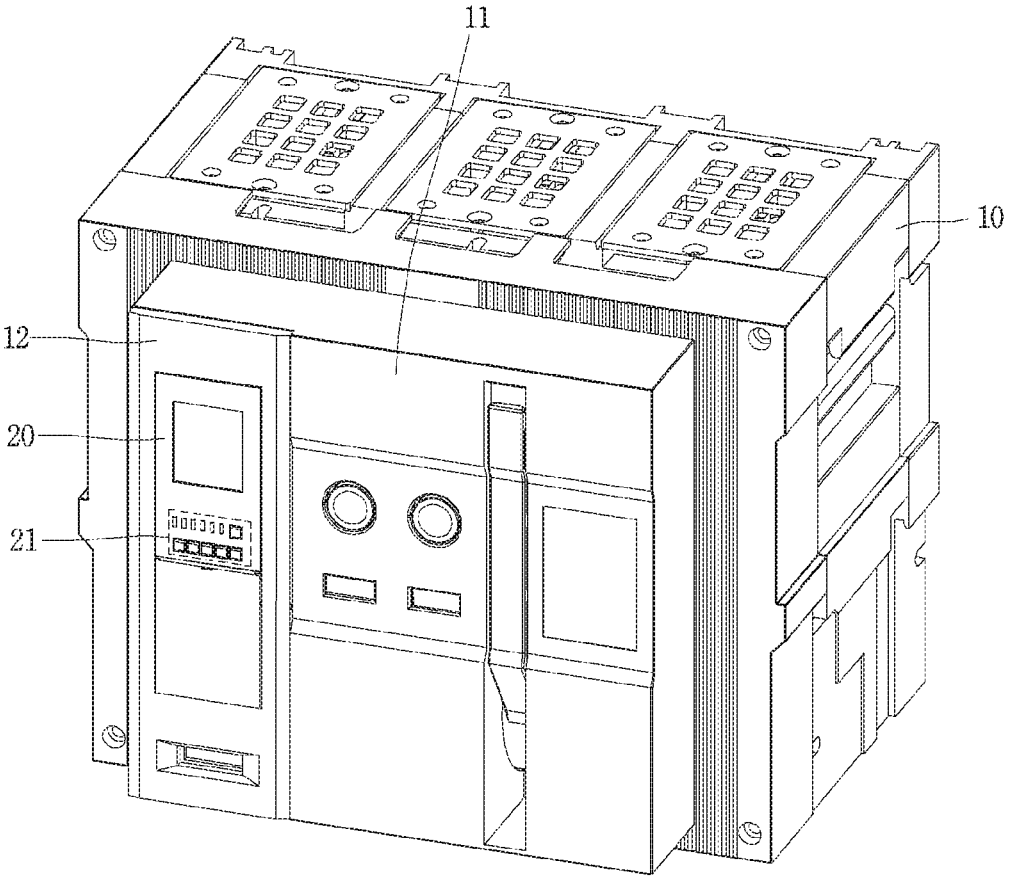
FIG. 1 PRIOR ART
FIG. 1 is a perspective view illustrating an outer appearance of a related art air circuit breaker.
Figure 2:
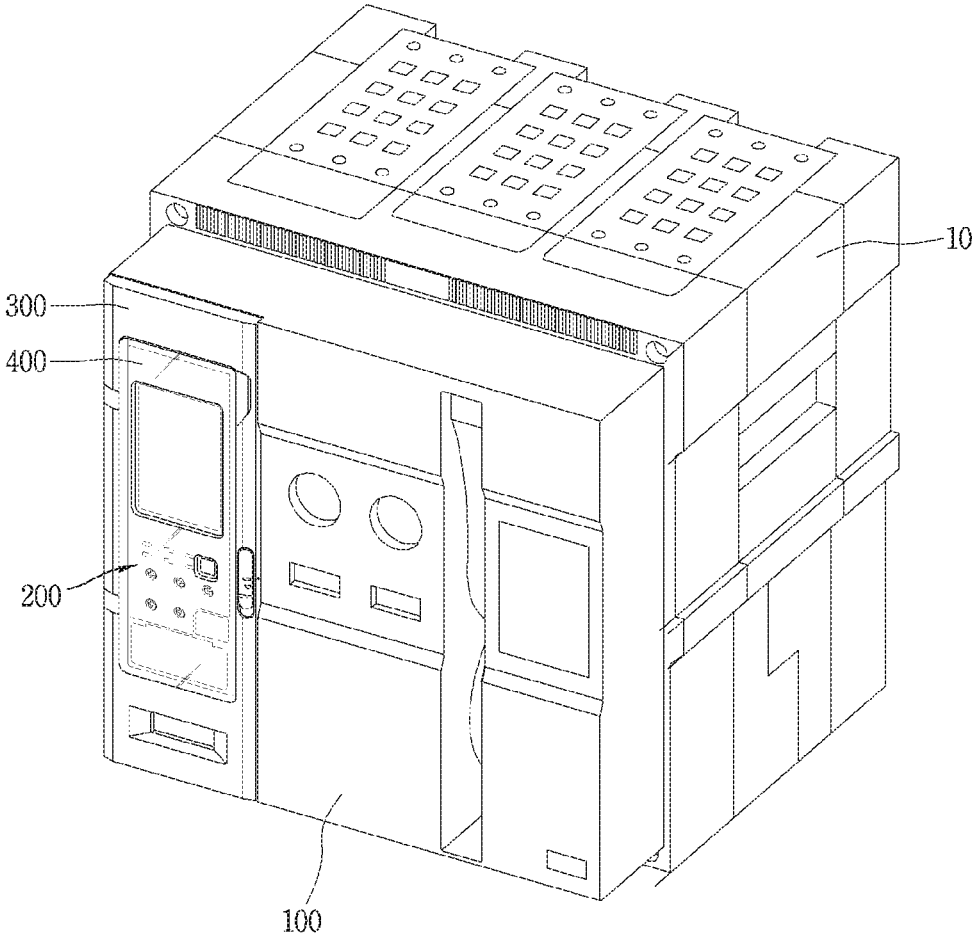
FIG. 2 is a perspective view of an air circuit breaker according to the present disclosure.
Figure 3:
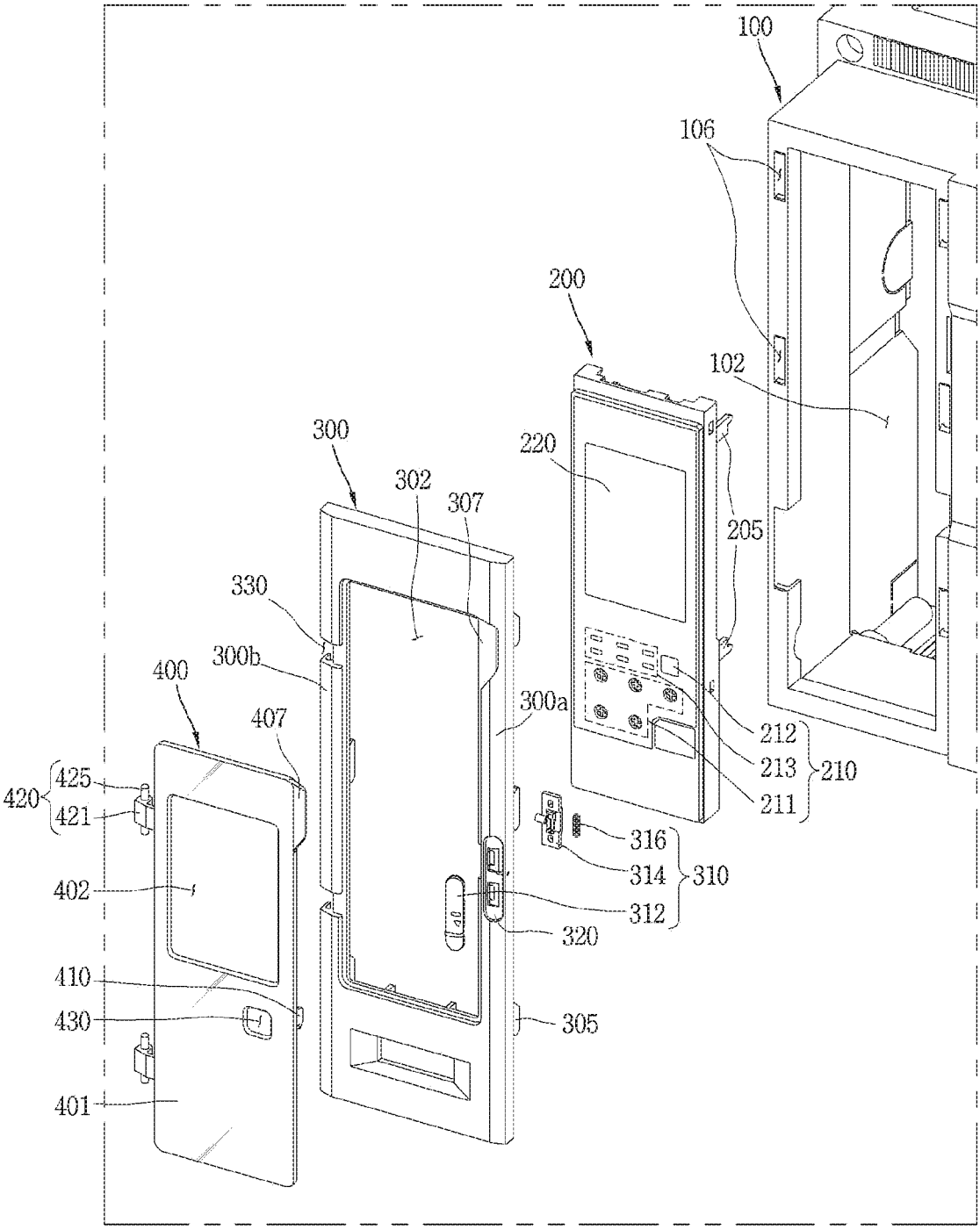
FIG. 3 is an exploded perspective view illustrating a main cover, an overcurrent trip relay, an auxiliary cover, and a safety cover of the air circuit breaker of FIG. 2.

FIG. 2 is a perspective view of an air circuit breaker according to the present disclosure. FIG. 3 is an exploded perspective view illustrating a main cover, an overcurrent trip relay, an auxiliary cover, and a safety cover of the air circuit breaker of FIG. 2.

An air circuit breaker according to one embodiment of the present disclosure includes a main cover 100, an overcurrent trip relay 200, an auxiliary cover 300, and a safety cover 400.

The main cover 100 is installed on one surface of a circuit breaker body 10. The one surface of the circuit breaker body 10 may be a front surface of the circuit breaker body 10. An overcurrent trip relay accommodating groove 102 is provided on one side of the main cover 100. A coupling hook insertion groove 106 in which a coupling hook 305 of the auxiliary cover 300 is fixedly inserted may be provided at a periphery of the overcurrent trip relay accommodating groove 102.

The overcurrent trip relay 200 is accommodated in the overcurrent trip relay accommodating groove 102 of the main cover 100. A coupling hook 205, coupled to an insertion groove formed inside the overcurrent trip relay accommodating groove 102, protrudes from a rear surface of the overcurrent trip relay 200.

A setting unit 210 used to set a setting value for a circuit breaking operation may be provided at a front surface of the overcurrent trip relay 200. The setting unit 210 of the overcurrent trip relay 200 may include an adjusting (or adjustment) knob (adjustment screw head) 211 used to set a plurality of reference values or operation sensitivity for the operation of the overcurrent trip relay 200, a restore button 212 used for restoring the overcurrent trip relay 200 when a predetermined event occurs, and an indicator (or signal) unit 213 that shows the on/off status of specific signals using a light-emitting diode, and the like.

Meanwhile, the overcurrent trip relay 200 may further include a display 220. Information regarding a voltage measured in the overcurrent trip relay 200, a usage environment, and abnormality or error detection in the air circuit breaker may be displayed on the display 220.

Here, the display 220 may be a touchable display. A touch input can be applied to the display 220, thereby allowing manipulation of the overcurrent trip relay 200. The touchable display 220 may be included in the setting unit 210 of the overcurrent trip relay 200.

The auxiliary cover 300 is connected to the main cover 100 so as to cover between the main cover 100 and the overcurrent trip relay 200. In detail, as the coupling hook 305 provided at a rear surface of the auxiliary cover 300 is inserted into the coupling hook insertion groove 106 of the main cover 100, the auxiliary cover 300 and the main cover 100 are coupled to each other.

The overcurrent trip relay 200 is smaller in size than the overcurrent trip relay accommodating groove 102 of the main cover 100. As the auxiliary cover 300 and the main cover 100 are coupled to each other, a space (or gap) between the overcurrent trip relay 200 and the main cover 100 may be covered.

The auxiliary cover 300 is provided with an opening 302 through which the overcurrent trip relay 200 is exposed to the outside. The opening 302 of the auxiliary cover 300 may have a size that corresponds to a size of the front surface of the overcurrent trip relay 200. The auxiliary cover 300 may partially cover a perimeter of the overcurrent trip relay 200. In addition, the opening 302 of the auxiliary cover 300 is formed such that the setting unit 210 and the display 220 of the overcurrent trip relay 200 are exposed to the outside.

A lever hook 310 to be described hereinafter is disposed on one longer side 300*a* of the auxiliary cover 300. Another longer side 300*b* of the auxiliary cover 300 is coupled with a rotating part 420 of the safety cover 400, thereby providing an axis for relative rotation of the safety cover 400.

Meanwhile, a flap groove 307 in which a flap (or wing) portion 407 of the safety cover 400 described hereinafter is inserted may be formed at an upper end of the one longer side 300*a* of the auxiliary cover 300. A smooth appearance may be achieved by the flap portion 407 of the safety cover 400 and the flap groove 307 of the auxiliary cover 300. In addition, when the safety cover 400 is rotated from the auxiliary cover 300, the safety cover 400 may be easily rotated using the flap groove 307.

The safety cover 400 may include a body 401 in which an opening 402 and a button hole 430 are formed, a fixing hook 410 provided at a right rear surface of the body 401, the flap portion 407 provided at a right upper end of the body 401, and the rotating part 420 provided at a left side of the body 401.

The safety cover 400 is connected to the auxiliary cover 300 so as to cover the setting unit 210 of the overcurrent trip relay 200 exposed to the outside through the opening 302 of the auxiliary cover 300.

Referring to FIGS. 2 and 3, the safety cover 400 is coupled to the another longer side 300*b* of the auxiliary cover 300. In detail, the rotating part 420 of the safety cover 400 is inserted into a rotating part insertion groove 330 of the auxiliary cover 300 to be coupled. In addition, the safety cover 400 is designed to be rotatable with respect to the auxiliary cover 300. The safety cover 400 may be made of a transparent material so that the setting unit 210 and the display 220 of the overcurrent trip relay 200 are visible from the outside.

Further, the safety cover 400 may have a size capable of covering the opening 302 of the auxiliary cover 300. As the setting unit 210 of the overcurrent trip relay 200 exposed to the outside through the opening 302 of the auxiliary cover 300 is covered by the safety cover 400, manipulation of the setting unit 210 is not available until the safety cover 400 is opened. Accordingly, an accident due to malfunction, or manipulation of the overcurrent trip relay 200 by an unauthorized person may be prevented.

As described above, the safety cover 400 may include the opening 402. The opening 402 may be formed in a position that corresponds to the display 220 of the overcurrent trip relay 200. Thus, the display 220 may be more easily seen from the outside through the opening 402.

In addition, when the display 220 is touchable as described above, the display 220 may be manipulated without opening the safety cover 400. However, an opening may not be provided in the safety cover 400 to prevent the display 220 from being touched in a closed state in which the safety cover 400 and the auxiliary cover 300 are coupled to each other.

When a predetermined event, such as an abnormal signal detection, occurs in the overcurrent trip relay 200, a signal (or status) may be displayed on the display 220 and/or indicator unit 213. Here, as a user presses the restore button 212, a signal that the event has been confirmed is applied to the overcurrent trip relay 200, and the overcurrent trip relay 200 is reverted to its original state.

To this end, the safety cover 400 may include the button hole 430 opened in a position corresponding to the restore button 212 so as to allow the restore button 212 to be pressed while the opening 302 of the auxiliary cover 300 is covered by the safety cover 400. The button hole 430 is provided in a position corresponding to the restore button 212, as shown in FIG. 2.

Accordingly, even when the safety cover 400 is closed with respect to the front surface of the overcurrent trip relay 200 by being coupled to the auxiliary cover 300, the user may easily press the restore button 212 through the button hole 430.

Figure 4A:
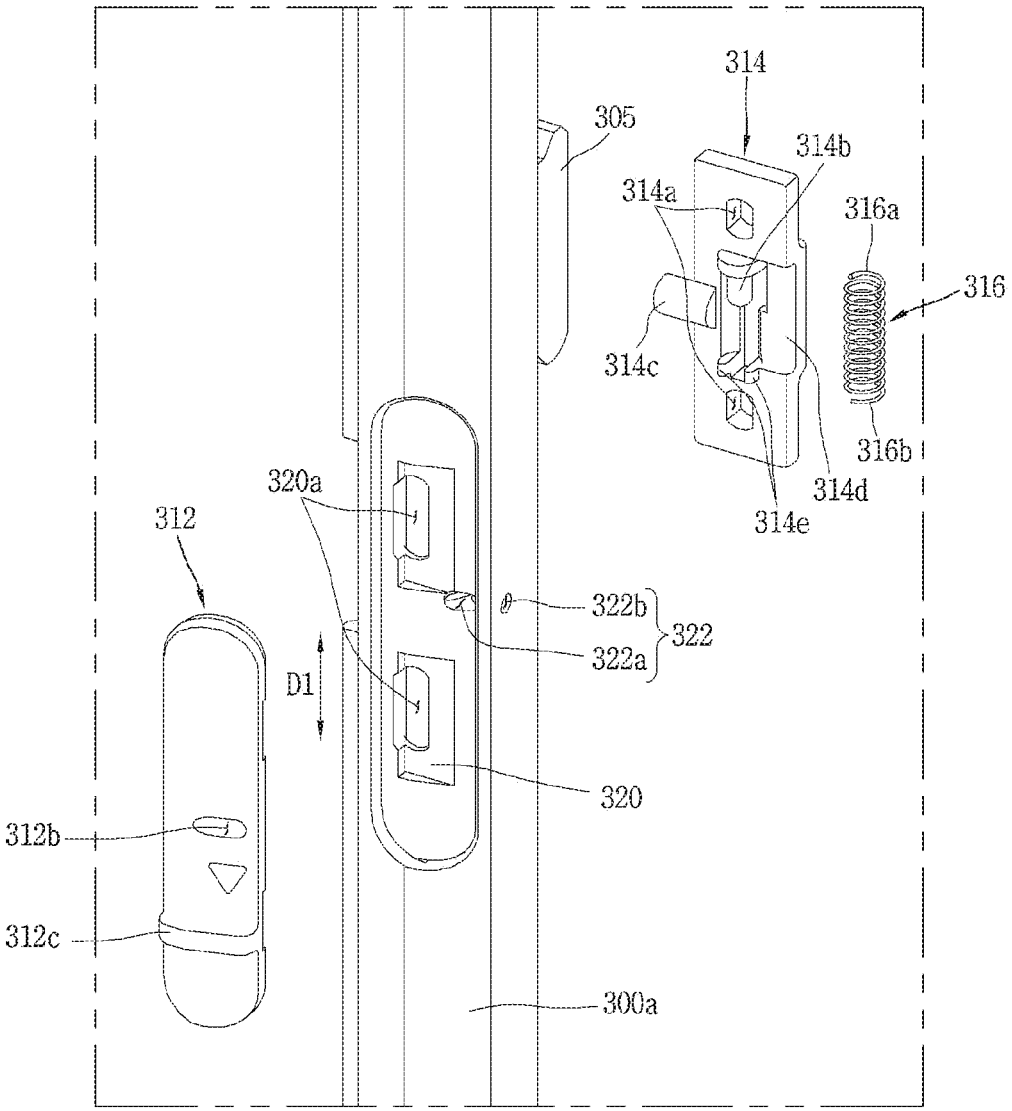
FIGS. 4A to 4C are exploded perspective and lateral views illustrating a process of coupling a lever hook to an auxiliary cover of an air circuit breaker according to an embodiment of the present disclosure.
Figure 4B:
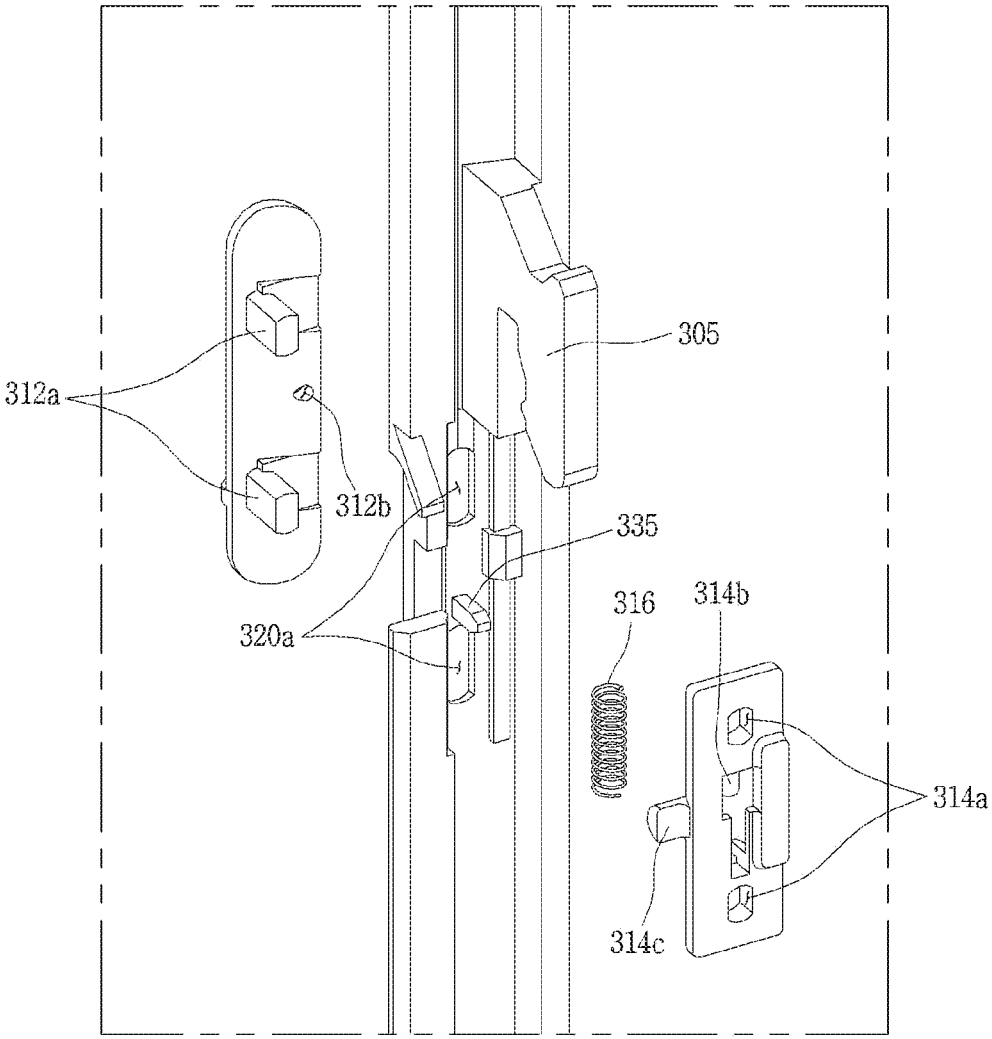
Figure 4C:
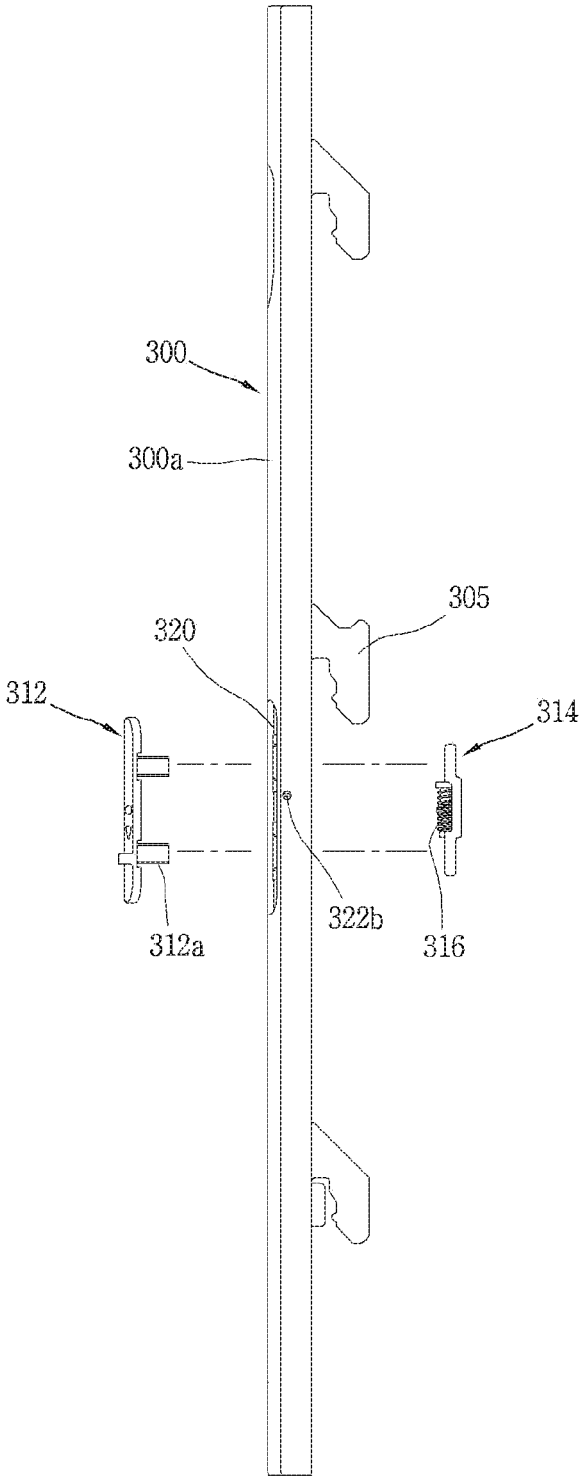

FIGS. 4A to 4C are exploded perspective and lateral views illustrating a process of coupling a lever hook to an auxiliary cover of an air circuit breaker according to an embodiment of the present disclosure.

In detail, FIG. 4A is a perspective view illustrating a portion of a first member 312, a second member 314, an elastic body 316, and an auxiliary cover 300 viewed from the front, FIG. 4B is a perspective view illustrating a portion of the first member 312, the second member 314, the elastic body 316, and the auxiliary cover 300 viewed from the rear, and FIG. 4C is a lateral view illustrating a portion of the first member 312, the second member 314, the elastic body 316, and the auxiliary cover 300. In addition, for the sake of convenience, the left and right sides are reversed in FIG. 4A and FIG. 4B.

Referring to the drawings, the auxiliary cover 300 of the air circuit breaker according to one embodiment of the present disclosure may further include the lever hook 310 designed to reciprocate on the auxiliary cover 300 in a direction D1. As the lever hook 310 reciprocates in the direction D1, the safety cover 400 and the auxiliary cover 300 are coupled to each other, or released (or separated) from each other.

In detail, the lever hook 310 may include the first member 312, the second member 314, and the elastic body 316.

The first member 312 is disposed at a front surface of the auxiliary cover 300. The first member 312 may be inserted into an insertion groove 320 of the auxiliary cover 300 and moved in the direction D1. A through hole 312*b* described hereinafter and a manipulation protrusion 312*c* that facilitates vertical (or up-and down) movement of the first member 312 may be provided on a front surface of the first member 312.

Referring to FIG. 4B, the first member 312 may be provided with a coupling protrusion 312*a* protruding from a rear surface thereof and penetrating through the auxiliary cover 300 and the second member 314. The coupling protrusion 312*a* may penetrate through an insertion hole 320*a* of the auxiliary cover 300 and a coupling hole 314*a* of the second member 314. In addition, referring to FIG. 4C, the first member 312 and the second member 314 are coupled to each other with the auxiliary cover 300 interposed therebetween.

The coupling protrusion 312*a* may be welded after passing through the auxiliary cover 300 and the second member 314, so as to have a cross-section width greater than a width of the coupling hole 314*a* of the second member 314.

In detail, in the process of coupling the first member 312 and the second member 314 to each other, the coupling protrusion 312*a* of the first member 312 passes through the insertion hole 320*a* of the auxiliary cover 300 and the coupling hole 314*a* of the second member 314. Then, an end of the coupling protrusion 312*a* may be welded through the use of ultrasonic waves, or the like. The end of the coupling protrusion 312*a* is welded by melting. When the melted end of the coupling protrusion 312*a* is cured over time, the cross-section width of the coupling protrusion 312*a* may be formed to be greater than the width of the coupling hole 314*a* of the second member 314.

Figure 5:
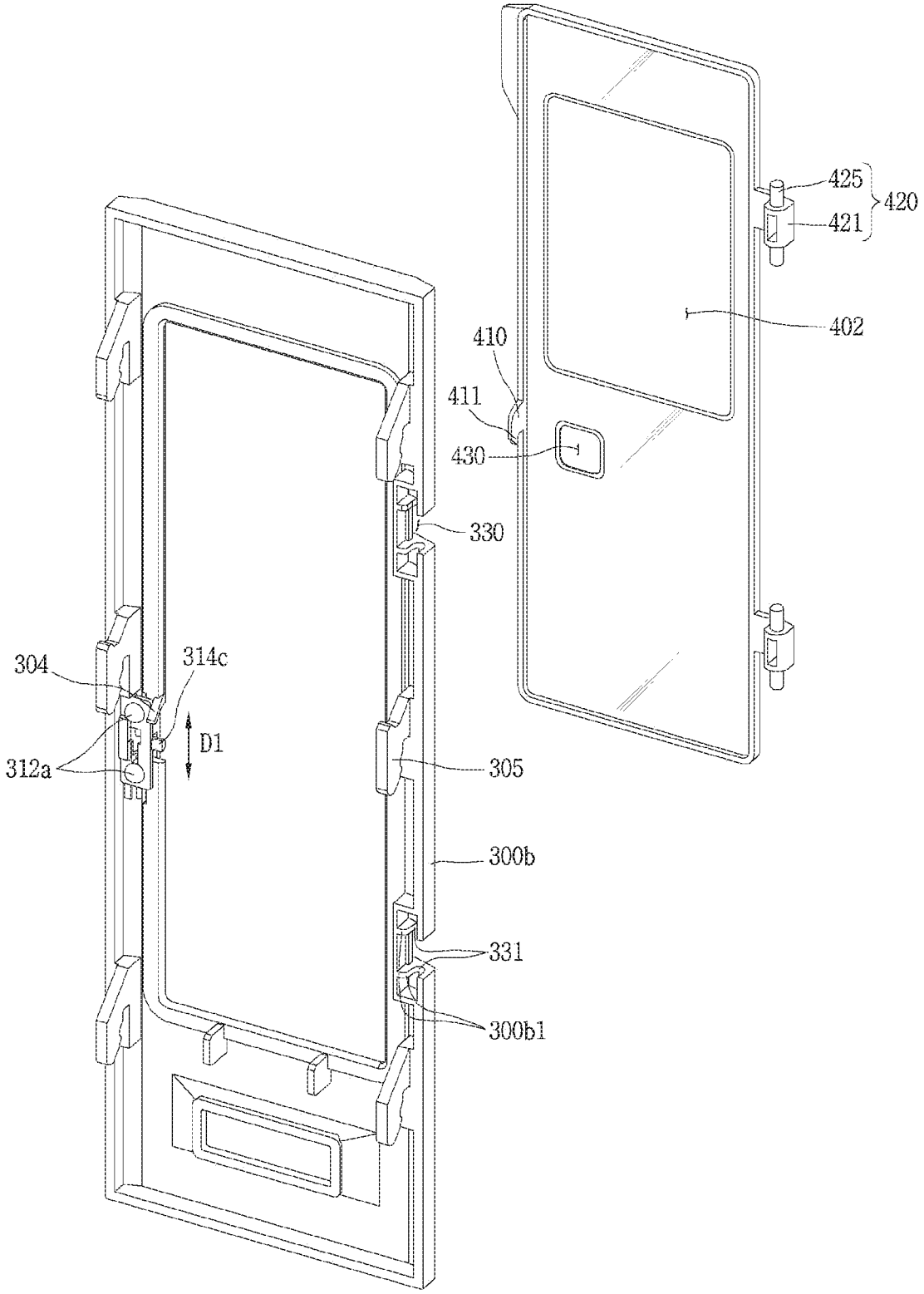
FIG. 5 is a perspective view illustrating an auxiliary cover and a safety cover of an air circuit breaker according to an embodiment of the present disclosure.

Referring to FIG. 5, as the end of the coupling protrusion 312*a* of the first member 312 is melted and cured, the coupling protrusion 312*a* may have a wider cross section. Accordingly, the coupling protrusion 312*a* is not separated from the second member 314, allowing the first member 312 and the second member 314 to be coupled to each other. That is, since the coupling protrusion 312*a* is not released through the coupling hole 314*b* of the second member 314, the first member 312 and the second member 314 may be securely coupled to each other.

The second member 314 is disposed in a position on the rear surface of the auxiliary cover 300 that corresponds to the first member 312. As described above, the second member 314 and the first member 312 are coupled to each other by the coupling protrusion 312*a*.

The second member 314 may include the coupling hole 314*a*, an elastic body insertion protrusion 314*b*, an engaging (or engagement) protrusion 314*c*, a body 314*d*, and an elastic body side support protrusion (hereinafter, side support protrusion) 314*e*.

As described above, the coupling protrusion 312*a* of the first member 312 penetrates through the coupling hole 314*a*. One end 316*a* of the elastic body 316 is inserted into the elastic body insertion protrusion 314*b* that supports the elastic body 316. The engaging protrusion 314*c* is coupled to the fixing hook 410 of the safety cover 400 so as to support the fixing hook 410 of the safety cover 400. The side support protrusion 314*e* supports a periphery (side) of another end 316*b* of the elastic body 316.

The side support protrusion 314*e* is configured as two support protrusions that protrude to be spaced apart from each other. A support protrusion 335 of the auxiliary cover 300 described hereinafter may be inserted between the two side support protrusions 314*e*.

The auxiliary cover 300 may be provided with the lever hook 310, namely, the insertion groove 320 in which the first member 312 is inserted. Here, the insertion groove 320 is recessed in a thickness direction to allow at least a portion of the first member 312 to be inserted in the thickness direction, so that a reciprocating region (or area) of the lever hook 310 in the direction D1 is limited.

Meanwhile, the insertion hole 320*a* of the auxiliary cover 300 may be formed as a long hole that is long in a vertical (or up-and-down) direction. Accordingly, the coupling protrusion 312*a* of the first member 312 that is inserted into the insertion hole 320*a* may be vertically moved by a predetermined distance.

The elastic body 316 is fixed between the auxiliary cover 300 and the second member 314 by the support protrusion 335 protruding from the rear surface of the auxiliary cover 300 and the elastic body insertion protrusion 314*b* protruding from the second member 314, so as to press (or pressurize) the second member 314. That is, the elastic body 316 is interposed between the second member 314 and the auxiliary cover 300, and the second member 314 is pressed in the direction D1 by the elastic body 316. Here, the elastic body 316 may be a coil spring.

The one end 316*a* of the elastic body 316 is inserted into the elastic body insertion protrusion 314*b* of the second member 314 as described above. When the one end 316*a* of the elastic body 316 is inserted into the elastic body insertion protrusion 314*b* of the second member 314 before the second member 314 is coupled to the auxiliary cover 300, the another end 316*b* of the elastic body 316 is fixed to the side support protrusion 314*e*.

When the second member 314 is coupled to the auxiliary cover 300 in a state that the elastic body 316 is coupled to the second member 314, the support protrusion 335 of the auxiliary cover 300 is inserted between the side support protrusions 314*e*. Here, when the second member 314 is moved downwards, the support protrusion 335 of the auxiliary cover 300 may pass between the two side support protrusions 314*e*.

Then, the elastic body 316 is pressed, and a force that returns the second member 314 to an upward position is increased accordingly. As a result, the first member 312 and the second member 314 are pressed and moved upwards in the direction D1.

That is, while the first member 312 and the second member 314 are coupled to each other, the one end 316*a* of the elastic body 316 is fitted to the elastic body insertion protrusion 314*b* of the second member 314, and the another end 316*b* of the elastic body 316 is fixed by being supported on the support protrusion 335 of the auxiliary cover 300.

In a state that the first member 312 and the second member 314 are coupled to each other, the second member 314 is pressed by the elastic body 316 and is moved upwards. As the second member 314 is moved to the upward position, the first member 312 connected with the second member 314 is also moved upwards. Here, a state in which the first member 312 and the second member 314 are moved to the upward position is defined as a 'first state'.

In the first state, the lever hook 310 is coupled to the fixing hook 410 of the safety cover 400. Accordingly, the safety cover 400 is not separated from the auxiliary cover 300. That is, as the elastic body 316 supported by the support protrusion 335 presses the second member 314, the lever hook 310 may be maintained in the first state in which the safety cover 400 is coupled to the auxiliary cover 300.

The safety cover 400 is provided with the fixing hook 410 protruding from a rear surface thereof. In detail, referring to FIGS. 3 and 5, the fixing hook 410 is provided at the rear surface of the safety cover 400, namely, a position that allows the safety cover 400 to be coupled to the engaging protrusion 314*c* of the lever hook 310.

An end 411 of the fixing hook 410 may be bent downwards in the direction D1, so that the engaging protrusion 314*c* is introduced (or received) when the lever hook 310 moves upwards in the direction D1. Accordingly, when the second member 314 is moved to the upward position, the engaging protrusion 314*c* is introduced between the end 411 of the fixing hook 410 and the safety cover 400, allowing the safety cover 400 to be fixed.

When the lever hook 310 is in the first state, the fixing hook 410 is engaged in the engaging protrusion 314*c* to be coupled to the auxiliary cover 300. Conversely, the fixing hook 410 is separated from the engaging protrusion 314*c* when the lever hook 310 is moved (or converted) from the first state to a second state in which the elastic body 316 is compressed.

Meanwhile, when the safety cover 400 is moved to a closed state while the safety cover 400 is separated from the auxiliary cover 300, the fixing hook 410 presses the engaging protrusion 314*c* of the lever hook 310 in the first state to move the lever hook 310 downwards, thereby being closer to the second state. In detail, one surface of the engaging protrusion 314*c* of the lever hook 310 that faces the fixing hook 410 is formed in a curved semicircular shape. The end 411 of the fixing hook 410 is inclined so as to move the engaging protrusion 314*c* while pressing.

When the safety cover 400 is located close to the auxiliary cover 300, the end 411 of the fixing hook 410 presses the engaging protrusion 314*c*, allowing the engaging protrusion 314*c* to be moved downwards. When the end 411 of the fixing hook 410 passes through the engaging protrusion 314*c*, the engaging protrusion 314*c* is returned to the upward position by the elastic body 316, allowing the engaging protrusion 314*c* to be inserted into a space between the fixing hook 410 and the safety cover 400. Then, the safety cover 400 is coupled and fixed to the auxiliary cover 300.

Referring to FIG. 4B, when the lever hook 310 moves upwards in the direction D1, the coupling protrusion 312*a* is engaged (or caught) by a stopper 304 so that movement may be limited (or restricted). In addition, when the lever hook 310 moves downwards in the direction D1, a compressive force of the elastic body 316, and a force of supporting the elastic body 316 by the support protrusion 335 may limit downward movement of the lever hook 310.

In the air circuit breaker according to one embodiment of the present disclosure, the lever hook 310 is maintained in the first state by the elastic body 316. In the first state, the fixing hook 410 of the safety cover 400 is engaged with the engaging protrusion 314*c* of the second member 314. Accordingly, the safety cover 400 is not separated from the auxiliary cover 300. With a simple structure, the present disclosure may prevent a malfunction or manipulation by an unauthorized user due to the setting unit 210 of the overcurrent trip relay 200 is exposed to the outside.

Meanwhile, the lever hook 310 and the auxiliary cover 300 may be provided with a sealing hole for sealing the lever hook 310 to the auxiliary cover 300, so as to suppress the lever hook 310 from being moved vertically.

The sealing hole includes the through hole 312*b* provided in the first member 312 and a communication hole 322 provided in the auxiliary cover 300.

In detail, referring to FIG. 4A, the through hole 312*b* may be formed through the first member 312 along a thickness direction, which penetrates from a front surface toward a side surface of the first member 312.

In addition, the auxiliary cover 300 may be provided with the communication hole 322 communicating with the through hole 312*b* at a position where the lever hook 310 is disposed when being pressed by the elastic body 316 in the direction D1. Here, the communication hole 322 communicates with the through hole 312*b* when the lever hook 310 is in the first state. At this time, the communication hole 322 may penetrate from a front communication hole 322*a* provided at a front surface of the auxiliary cover 300 to a lateral communication hole 322*b* of the auxiliary cover 300.

The user may insert a wire, or the like into the sealing hole to make it fixed and bonded, thereby preventing the lever hook 310 from being converted to the second state from the first state.

In the air circuit breaker according to one embodiment of the present disclosure, the wire should be removed from the sealing hole to open the safety cover 400 with respect to the auxiliary cover 300. Accordingly, the setting unit 210 of the overcurrent trip relay 200 may be prevented from malfunctioning or being operated by an unauthorized user.

Figure 6:
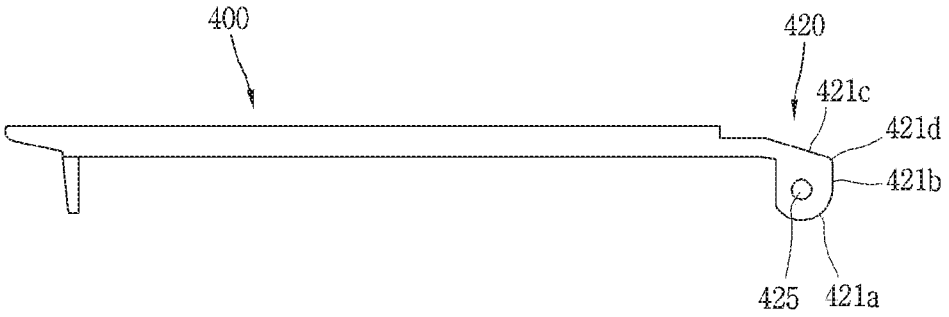
FIGS. 6 to 7C are planar views illustrating rotation of a rotating part of the safety cover and the safety cover of FIG. 5 with respect to the auxiliary cover.

FIG. 5 is a perspective view illustrating an auxiliary cover and a safety cover of an air circuit breaker according to an embodiment of the present disclosure. FIGS. 6 and 7 are planar views illustrating rotation of a rotating part of the safety cover and the safety cover of FIG. 5 with respect to the auxiliary cover.

The safety cover 400 may include the rotating part 420 provided in a position corresponding to the another longer side 300*b* of the auxiliary cover 300. The rotating part 420 protrudes from one side of the safety cover 400. The rotating part 420 is inserted into the rotating part insertion groove 330 of the auxiliary cover 300, so that the safety cover 400 is rotatable relative to the auxiliary cover 300.

The rotating part 420 may include a rotating body 421 disposed adjacent to or in contact with the auxiliary cover 300 or the main cover 100 and an extension pin 425 protruding from the rotating body 421.

A coupling relationship between the safety cover 400 and the auxiliary cover 300 is as follows. The rotating body 421 is inserted into the rotating part insertion groove 330. The extension pin 425 is inserted into an extension pin insertion groove 331 provided in a support portion 300*b*1 disposed at upper and lower portions of the rotating part insertion groove 330.

As the support portion 300*b*1 is disposed by surrounding the extension pin 425, the rotating part 420 may not be separated from the rotating part insertion groove 330, and thus the safety cover 400 may be securely fixed to the auxiliary cover 300. Meanwhile, when the fixing hook 410 of the safety cover 400 presses the engaging protrusion 314*d* of the second member 314, the lever hook 310 may be moved downwards in the direction D1, as described above.

The rotating body 421 includes a first surface 421*a* formed as a continuously curved surface, a second surface 421*b* extending from the first surface 421*a* and formed as a flat surface, and a third surface 421*c* extending at a predetermined angle with respect to the second surface 421*b* and formed as a flat surface.

Figure 7A:
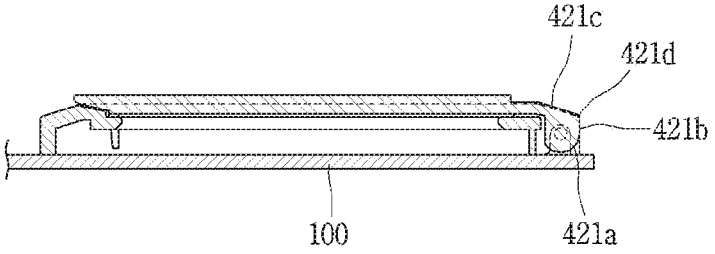

Referring to FIG. 6 and FIG. 7A, the first surface 421*a* is brought into contact with or disposed adjacent to the main cover 100 in a state that the safety cover 400 is closed with respect to the auxiliary cover 300. A cross section of the first surface 421*a* may be at least a portion of a circumference. As the first surface 421*a* is implemented as a curved surface, the first surface 421*a* is brought into contact with the main cover 100 so that pressure is not additionally applied to the main cover 100 by the first surface 421*a* when the safety cover 400 is rotated. Accordingly, when the first surface 421*a* is brought into contact or located adjacent to the main cover 100, the safety cover 400 may be smoothly rotated with respect to the auxiliary cover 300. Meanwhile, the rotating body 421 of the safety cover 400 may be brought into contact with the auxiliary cover 300 rather than the main cover 100 while rotating.

Figure 7B:
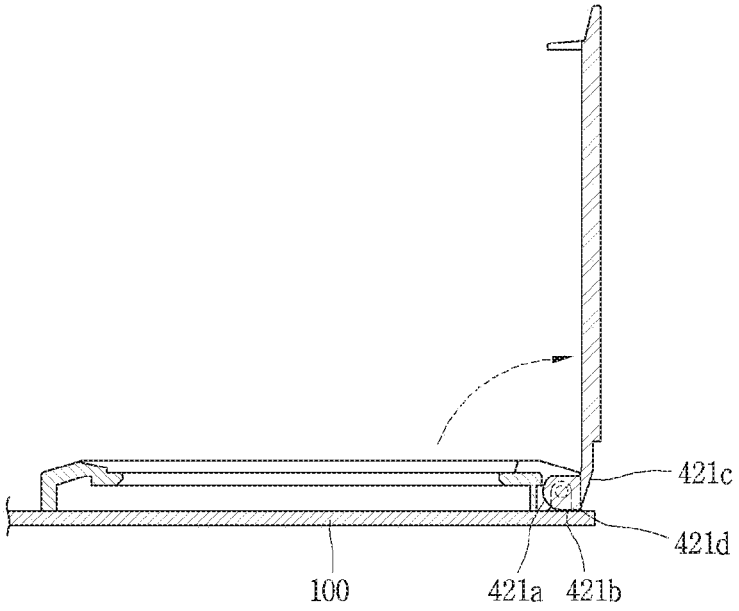

Referring to FIG. 6 and FIG. 7B, as the safety cover 400 is rotated, the second surface 421*b* extending from the first surface 421*a* and formed as a flat surface is brought into contact with the main cover 100. As the second surface 421*b* is implemented as the flat surface, an area that is in contact with the main cover 100 is increased. Further, as the second surface 421*b* and the main cover 100 are brought into contact with each other, no further rotation occurs unless a predetermined force or more is applied.

In a state of FIG. 7B, when further rotating the safety cover 400 in its original rotation direction, an engaging (or bent) portion 421*d* that is a bent line between the second surface 421*b* and the third surface 421*c* is caught (or engaged) in the main cover 100. Thus, the safety cover 400 is not rotated unless a constant force or more is applied. A rotation from FIG. 7A to FIG. 7B is defined as a 'first rotation state'.

In the first rotation state, the safety cover 400 may be rotated back to the auxiliary cover 300 even with a force less than the constant force. This is because rotation of the safety cover 400 in a direction to be opened with respect to the auxiliary cover 300 is limited (or restricted) by the second surface 421*b* and the engaging portion 421*d*. On the other hand, rotation of the safety cover 400 in a direction to be closed toward the auxiliary cover 300 is easily caused since the first surface 421*a* having relatively little resistance is brought into contact with or disposed adjacent to the main cover 100.

In a state of FIG. 7B, when a predetermined level of force or more is applied to the safety cover 400 in the same direction as the original rotation direction (opening direction), the engaging portion 421*d* and/or the main cover 100 made of an elastic material may be instantaneously deformed by an elastic force, so that the safety cover 400 may be further rotated.

Figure 7C:
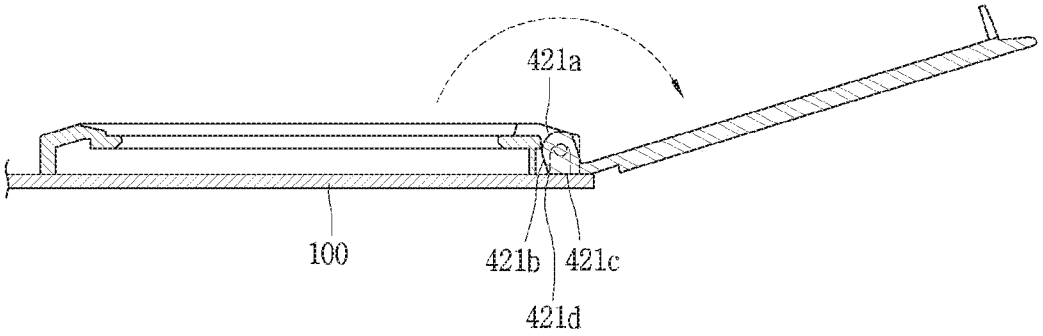

In detail, referring to FIG. 6 and FIG. 7C, as the second surface 421*b* that is in contact with the main cover 100 is rotated, the third surface 421*c* may be brought into contact with the main cover 100. That is, the engaging portion 421*d* of the safety cover 400 is rotated while pushing the main cover 100.

Here, as the third surface 421*c* is extended at a predetermined angle with respect to the second surface 421*b* and formed as a flat surface, no further rotation of the safety cover 400 occurs in a state that the third surface 421*c* is in contact with the main cover 100. This state in which the third surface 421*c* is in contact with the main cover 100 is defined as a 'second rotation state'.

In the second rotation state, when rotating the safety cover 400 in a direction opposite to the rotation or opening direction, the engaging portion 421*d*, which is a bent line between the second surface 421*b* and the third surface 421*c*, is engaged in the main cover 100 again. Accordingly, the safety cover 400 is not rotated. That is, in the second rotation state, the safety cover 400 is rotated only when a predetermined level of force or more is applied in a direction that the safety cover 400 is coupled to the main cover 100 (i.e., a closed direction). As described above, as the third surface 421*c* is brought into contact with the main cover 100, the engaging portion 421*d* is brought into contact with the main cover 100, which suppresses (or interferes) the safety cover 400 from being rotated to the closed direction.

In this second rotation state, the safety cover 400 may be returned to the first rotation state again only when the predetermined level of force or more is applied to the safety cover 400. The safety cover 400 is not easily rotated while the safety cover 400 is in the opened state, namely, the second rotation state, and thus the user may conveniently manipulate the overcurrent trip relay 200.

That is, in the first rotation state, the safety cover 400 may be rotated back to the auxiliary cover 300 with a small force, the safety cover 400 may be closed again while the user manipulates the overcurrent trip relay 200 with the safety cover 400 opened. In this case, the user may manipulate the overcurrent trip relay 200 after rotating the safety cover 400 to the second rotation state from the first rotation state. Accordingly, the safety cover 400 is not closed toward the auxiliary cover 300 again while the user manipulates the overcurrent trip relay 200.

Although embodiments have been described with reference to a number of illustrative embodiments thereof, it should be understood that numerous other modifications and embodiments can be devised by those skilled in the art that will fall within the scope of the principles of this disclosure.

The invention claimed is:

1. An air circuit breaker, comprising:

a main cover installed on one surface of a circuit breaker body and having an overcurrent trip relay accommodating groove provided on one side thereof;

an overcurrent trip relay accommodated in the overcurrent trip relay accommodating groove and provided with a setting unit configured to set a set value for a circuit breaking operation;

an auxiliary cover connected to the main cover so as to cover between the main cover and the overcurrent trip relay, and provided with an opening through which the overcurrent trip relay is exposed to outside; and a safety cover connected to the auxiliary cover so as to cover the setting unit of the overcurrent trip relay exposed to the outside through the opening, and designed to be rotatable with respect to the auxiliary cover, wherein the auxiliary cover further comprises a lever hook configured to reciprocate on the auxiliary cover in a specific direction, so that the safety cover is coupled to the auxiliary cover, or is separated from the auxiliary cover.

2. The air circuit breaker of claim 1, wherein the safety cover includes a rotating part protruding from one side thereof and inserted into the auxiliary cover so as to allow the safety cover to rotate relative to the auxiliary cover, and wherein the rotating part comprises:

a first surface formed as a continuously curved surface;

a second surface extending from the first surface and formed as a flat surface; and a third surface extending at a predetermined angle with respect to the second surface and formed as a flat surface.

3. The air circuit breaker of claim 2, wherein the safety cover, when rotating relative to the auxiliary cover, is rotatable to a first rotation state in which the second surface is brought into contact with the auxiliary cover or the main cover so that no further rotation is allowed in the first rotation state, and a second rotation state in which the safety cover further rotates in an original rotation direction from the first rotation state by receiving a predetermined pressure so that the third surface is brought into contact with the auxiliary cover or the main cover in the second rotation state.

4. The air circuit breaker of claim 1, wherein the lever hook comprises:

a first member disposed at a front surface of the auxiliary cover;

a second member disposed in a position on a rear surface of the auxiliary cover that corresponds to the first member; and an elastic body interposed between the second member and the auxiliary cover, and wherein the first member and the second member are coupled to each other with the auxiliary cover interposed therebetween, and are pressed in the specific direction by the elastic body.

5. The air circuit breaker of claim 4, wherein the first member includes a coupling protrusion protruding from a rear surface thereof and penetrating through the auxiliary cover and the second member, and wherein the second member is provided with a coupling hole through which the coupling protrusion passes.

6. The air circuit breaker of claim 5, wherein the coupling protrusion is welded after passing through the auxiliary cover and the second member, so that the coupling protrusion has a cross-section width greater than a width of the coupling hole of the second member.

7. The air circuit breaker of claim 4, wherein the auxiliary cover is provided with an insertion groove recessed in a thickness direction to allow at least a portion of the first member to be inserted in the thickness direction, so that a reciprocating region in the specific direction is limited.

8. The air circuit breaker of claim 7, wherein the first member is provided with a through hole penetrating from a front surface toward a side surface thereof in a thickness direction, and wherein the auxiliary cover is provided with a communication hole communicating with the through hole at a position where the lever hook is disposed when being pressed by the elastic body in the specific direction.

9. The air circuit breaker of claim 8, wherein the communication hole is formed through a front surface and a side surface of the auxiliary cover.

10. The air circuit breaker of claim 7, wherein the auxiliary cover includes a support protrusion that protrudes from a rear surface thereof and supports one end of the elastic body, wherein the second member includes an insertion protrusion protruding therefrom so as to allow another end of the elastic body to be inserted, and wherein the elastic body supported by the support protrusion presses the second member such that the lever hook is maintained in a first state in which the safety cover is coupled to the auxiliary cover.

11. The air circuit breaker of claim 10, wherein the second member further comprises an engaging protrusion protruding toward the opening of the auxiliary cover, wherein the safety cover includes a fixing hook protruding from a rear surface of the safety cover, and wherein the fixing hook is engaged with the engaging protrusion to be coupled to the auxiliary cover when the lever hook is in the first state, and is separated from the engaging protrusion when the lever hook is moved from the first state to a second state in which the elastic body is pressed.

12. An air circuit breaker, comprising:

a main cover installed on one surface of a circuit breaker body and having an overcurrent trip relay accommodating groove provided on one side thereof;

an overcurrent trip relay accommodated in the overcurrent trip relay accommodating groove and provided with a setting unit configured to set a set value for a circuit breaking operation;

an auxiliary cover connected to the main cover so as to cover between the main cover and the overcurrent trip relay, and provided with an opening through which the overcurrent trip relay is exposed to outside; and a safety cover connected to the auxiliary cover so as to cover the setting unit of the overcurrent trip relay exposed to the outside through the opening, and designed to be rotatable with respect to the auxiliary cover, wherein the setting unit of the overcurrent trip relay includes a restore button for restoring the overcurrent trip relay by checking a displayed signal when a predetermined event occurs, and wherein the safety cover is provided with a button hole opened at a position corresponding to the restore button so as to allow the restore button to be pressed while the opening of the auxiliary cover is covered by the safety cover.

* * * * *